US005664935A

United States Patent [19]

Nishiuchi et al.

[11] Patent Number: 5,664,935

[45] Date of Patent: Sep. 9, 1997

[54] VACUUM PUMP

[75] Inventors: Akira Nishiuchi, Chiyoda-machi; Masahiro Mase, Nogi-machi; Noboru Matsumura, Chiyoda-machi; Katsuaki Kikuchi, Tsuchiura; Takashi Nagaoka, Tsukuba, all of Japan

[73] Assignee: Hitachi, Ltd., Japan

[21] Appl. No.: 528,413

[22] Filed: Sep. 14, 1995

[30] Foreign Application Priority Data

Sep. 19, 1994 [JP] Japan ..... 6-222969

[51] Int. Cl.[6] ..... F01D 1/36

[52] U.S. Cl. ..... 415/90; 415/143

[58] Field of Search ..... 415/90, 143, 198.1, 415/199.1

[56] References Cited

U.S. PATENT DOCUMENTS

| | | | |
|---|---|---|---|
| 4,390,317 | 6/1983 | Lehmann et al. | 415/143 |
| 4,726,734 | 2/1988 | Zientek et al. | 415/143 |
| 4,747,749 | 5/1988 | Sagnes | 415/143 |
| 4,808,067 | 2/1989 | Saulgeot | 415/90 |
| 5,051,060 | 9/1991 | Fleishmann et al. | 415/90 |
| 5,059,092 | 10/1991 | Kabelitz et al. | 415/90 |
| 5,536,148 | 7/1996 | Nishiuchi et al. | 415/90 |
| 5,553,998 | 9/1996 | Muhlhoff et al. | 415/90 |

FOREIGN PATENT DOCUMENTS

| | | |
|---|---|---|
| 62-258186 | 11/1987 | Japan . |
| 63-61798 | 3/1988 | Japan . |
| 3-7039 | 1/1991 | Japan . |

*Primary Examiner*—John T. Kwon

*Attorney, Agent, or Firm*—Evenson, McKeown, Edwards & Lenahan P.L.L.C.

[57] ABSTRACT

A dry turbo vacuum pump has a multistage circumferential impeller supported on a shaft, and a stator which cooperates with it to form a multistage peripheral flow pump. A centrifugal pump arranged at an inlet side of the peripheral flow pump is also mounted on the same shaft, so that gas sucked from the inlet is discharged to the atmosphere from the peripheral flow pump. The multistage peripheral flow pump and at least one stage of the centrifugal pump are integrated.

8 Claims, 11 Drawing Sheets

VACUUM PUMP

BACKGROUND OF THE INVENTION

The present invention relates to a vacuum pump which outputs an atmospheric pressure in its exhaust duct and, more particularly, to a dry turbo vacuum pump of the type used for manufacturing semiconductors, food and chemicals and suited for establishing a vacuum which is free from contaminants such as oil.

In a prior art dry turbo vacuum pump which generates an atmospheric pressure in its exhaust duct, such as disclosed in Japanese Patent Publication No. 3-7039/1991, the peripheral flow pump stages are cast to very close tolerances because they are difficult to machine, and are fastened to machined centrifugal pump stages by means of screws to construct the impeller stage. It is detailed in Japanese Patent Laid-Open No. 63-61798/1988 to manufacture such impeller by a high precision casting process.

As disclosed in Japanese Patent Laid-Open No. 62-258186/1987, on the other hand, the stator of the vacuum pump is recessed in the portion of the interstage walls of the stator at the opposite side of the impeller.

In the vacuum pump according to Japanese Patent Publication No. 3-7039/1991, special assembly steps are necessary to attach the centrifugal pump stages to the peripheral flow pump stages, and also to retain the concentricity of the impeller and prevent frictional facial contact. As a result of combining multiple parts, the dimensional errors of each are accumulated, making it difficult to manage and retain the proper clearances between the impeller and the stator, so as to retain the performance required of the vacuum pump.

The casting process disclosed in Japanese Patent Laid-Open No. 3-61798/1991 for manufacturing the impeller, on the other hand, diminishes the dimensional accuracy, and causes variation in the performance of the product. Moreover, it is difficult to correct internal defects, and thus parts with defects which are discovered after the casting work must be disposed of. As a result, the production yield is not satisfactory.

Furthermore, the impeller casting process according to Japanese Patent Laid-Open No. 62-258186/1987, requires resort to the lost wax process, in which the required material is very expensive.

SUMMARY OF THE INVENTION

An object of the present invention is to provide a dry turbo vacuum pump which has a reduced number of parts, so that it can be made compact and dimensionally managed with ease.

Another object of the present invention is to provide a dry turbo vacuum pump which reduces the variation in its performance due to several manufacturing factors.

In order to achieve the above-specified objects, there is provided a dry turbo vacuum pump which comprises: a housing having an inlet and an exhaust duct; a shaft supported rotatably in the housing; a multistage circumferential impeller supported on the shaft; a stator which cooperates with the circumferential impeller in the housing to form a multistage peripheral flow pump; and a centrifugal pump arranged at the inlet side of the peripheral flow pump, whereby the gas sucked from the inlet is discharged to the atmosphere from the exhaust duct. According to the invention, the multistage peripheral flow pump and at least one stage of the centrifugal pump are integrated.

Preferably, the circumferential impeller includes a base plate and a plurality of blades arranged on the base plate at a spacing from each other. Grooved bottoms between the blades are radially shaped to have a set of interrupted steps or linear lines.

According to another feature of the invention, those portions of the stage walls (between the stages of the stator) which face the impeller can be made flat, which simplifies the manufacturing process as described hereinafter.

In another embodiment of the invention, the stator is split into two halves, each of which is formed with a cooling channel portion, and the halves are individually formed with communication passages between the cooling channels thereof.

A further embodiment of the invention comprises a motor having a rotor which drives the multistage peripheral flow pump and a stator which is accommodated in a motor casing. The motor casing in turn is formed with an oil tank, the stator is formed in its outer circumference with a cooling channel, and the motor casing is formed in its outer circumference with a motor cooling channel. An oil circulating passage is formed to provide sequential communications among the oil tank, the motor cooling channel and the cooling channel.

Preferably, in the dry turbo vacuum pump according to the invention, the portion of the stator which is adjacent the impeller, is flat so that it can be manufactured by an ordinary casting process, without special measures.

Preferably, communication between the oil tank and the cooling channel portion of the casing is provided by way of communication passages formed in ribs on the outer circumference of the motor casing and on the outer circumference of the stator.

In another embodiment of the invention, the multistage peripheral flow pump and at least one stage of the centrifugal pump are integrated, and a spacer is interposed between a holder for an upper bearing supporting the shaft and the stator.

Since the circumferential impeller according to the invention, unlike the prior art impellers, which (due to their complex geometry) are made by a precision casting process, is so shaped that it can be machined by a multispindle numerical control machine, the peripheral flow pump and at least one stage of the centrifugal pump can be integrally machined. As a result, the step of assembling the peripheral flow pump and the centrifugal pump can be eliminated. Moreover, such integral machining can improve the machining accuracy and accurately control the clearance between the impeller and the stator, thereby providing a pump having a small variation in performance.

Flattening of the portions of interstage walls of the stator which are adjacent the impeller facilitates the release of the mold, thus allowing the use of an ordinary casting process, without special control measures. As a result, the cost for the material can be lowered to about one tenth that of the high precision casting process of the prior art using the lost wax technique.

Moreover, because the motor casing and the stator are formed with cooling channels integrated therein, and further with cooling passages for supplying the oil to and discharging it from the cooling channels, no special piping for the cooling oil is required. Thus, the external piping is substantially reduced, improving the workability of the device, and facilitating inspection and maintenance after installation.

DETAILED DESCRIPTION OF THE DRAWINGS

Figure 1A:
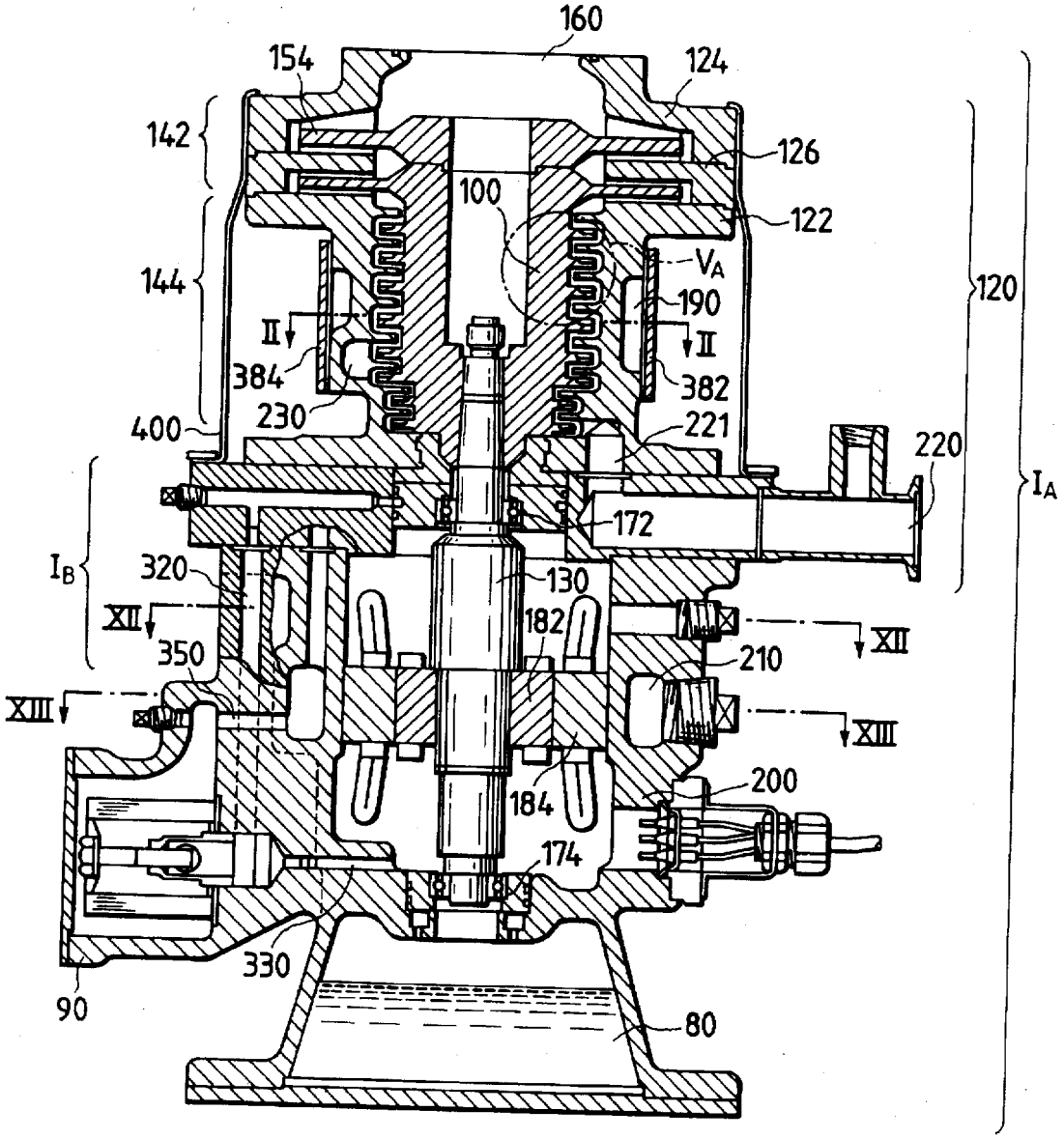
FIG. 1*a* is a longitudinal section showing one embodiment of the present invention.

FIG. 1*a* is a diagram showing a first embodiment of the present invention. A shaft 130 is vertically arranged to have its intermediate and lower end portions borne by roller bearings 172 and 174. Between these bearings a rotor 182 of a high frequency motor is press fitted on the shaft 130. On the upper portion of shaft 130, there is press fitted and fastened a pump rotor 100 (referred to herein as simply the "rotor") which is constructed by unifying or integrating at least one stage of a multiple stage circumferential impeller of a peripheral flow pump 144 and at least one stage of a multiple stage centrifugal impeller of a centrifugal pump 142. The rotor 100 is coaxially housed (with a clearance) in a pump stator 120 (referred to hereinafter as the "stator"), including a sealed suction casing 124 which forms an inlet 160 of the pump. In the outer circumference of the stator 120, there is formed a cooling channel 190 which contains a coolant for extracting the heat generated by the pumping action.

A motor stator 184 of the high frequency motor is arranged radially outward from and adjacent to the motor rotor 182, and is held in a motor casing 200. A cooling channel 210 is formed in the motor casing 200, radially outward from the motor stator 184 and the motor rotor 182, for cooling the motor.

Figure 1B:
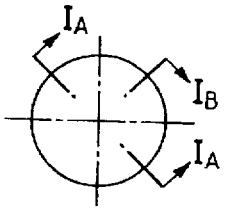
FIG. 1*b* is a top view which shows the section lines for FIG. 1*a;*

FIG. 1 *b* shows the location of the section planes of FIG. 1*a*. Section $I_B$ is rotated by approximately 90° from Section $I_A$, and shows the details of the oil supply system discussed hereinafter.

This embodiment of the present invention operates as follows:

As the shaft 130 and the rotor 100 are driven at a high speed (about 30,000 rpm) by the motor composed of the high frequency motor rotor 182 and the high frequency motor stator 184 in response to a command of a control unit (not shown), the gas sucked from the inlet 160 is sequentially compressed through the centrifugal pump stages 142 and the peripheral flow pump stages 144 until the compressed gas is discharged through a passage 221 and an exhaust duct 220.

Figure 2:
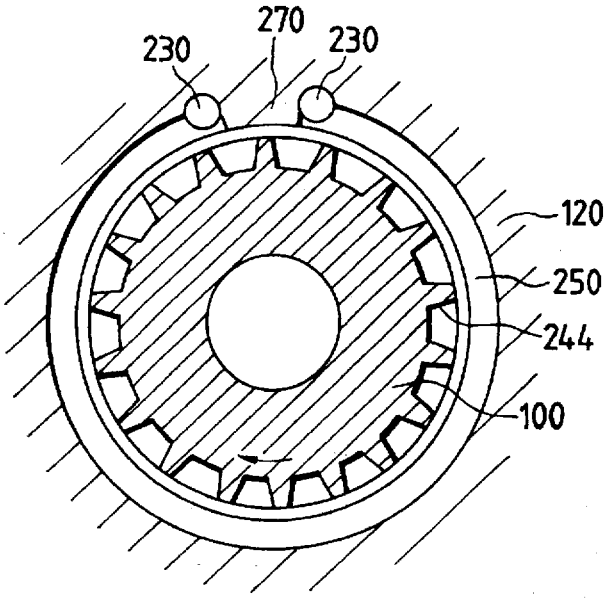
FIG. 2 is a transverse section of the pump rotor of the embodiment shown in FIG. 1.

FIG. 2 is a transverse section of one stage of the peripheral flow pump 144 taken along lines II—II in FIG. 1. In each stage of the peripheral flow pump, the gas is introduced from an inlet 230 and is given a circumferential velocity component by a circumferential impeller 240 rotating at a high speed. Then, the gas is propelled radially outward from the circumferential impeller 240 by centrifugal force and decelerates to restore the pressure in a passage 250 until it flows again into the circumferential impeller 240. The gas while passing through the passage 250, receiving an energy from the circumferential impeller 240 so that it flows helically in the passage 250, from an outlet 230 (which constitutes the inlet for the next pump stage) to the next stage. A high pressure ratio can be achieved by performing the actions successively in a plurality of stages, so that the gas can be directly discharged to the atmosphere.

Figure 3:
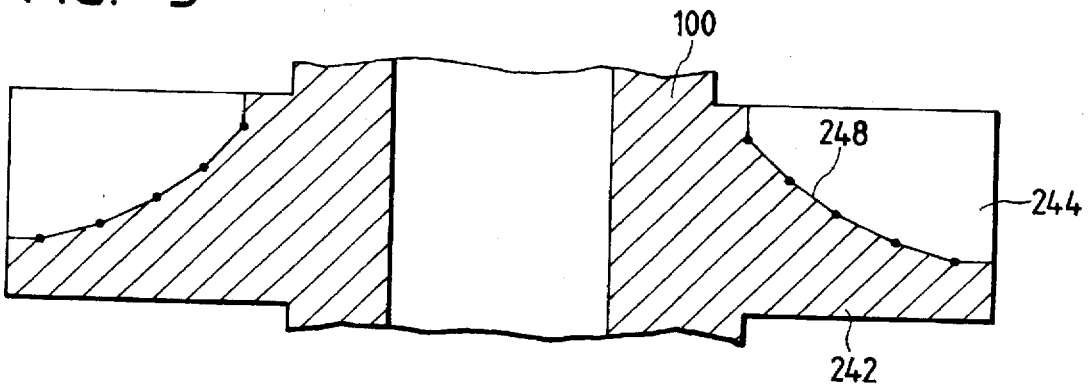
FIGS. 3 and 4 are detailed longitudinal sections of a peripheral flow pump of respective embodiments of the present invention.
Figure 4:
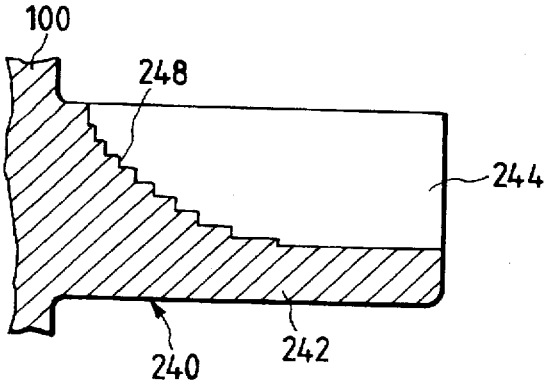
Figure 5A:
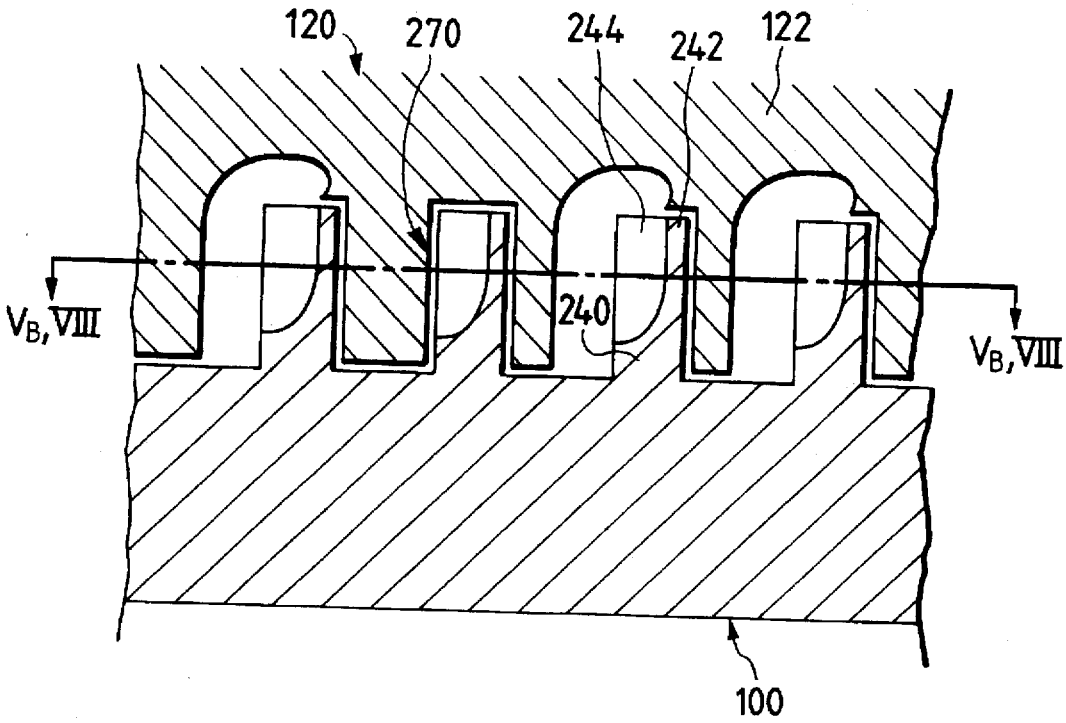
FIG. 5*a* is an enlarged cross-sectional view of a portion of FIG. 1 indicated by the circle VA.
Figure 5B:
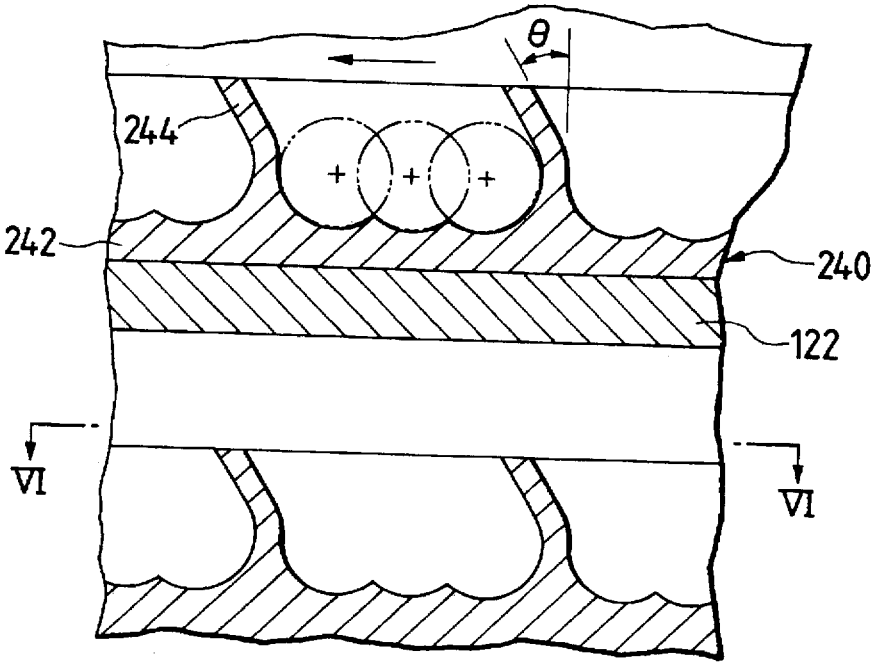
FIG. 5*b* is a view taken from the outer circumference of the embodiment shown in FIGS. 3 and 4.
Figure 6:
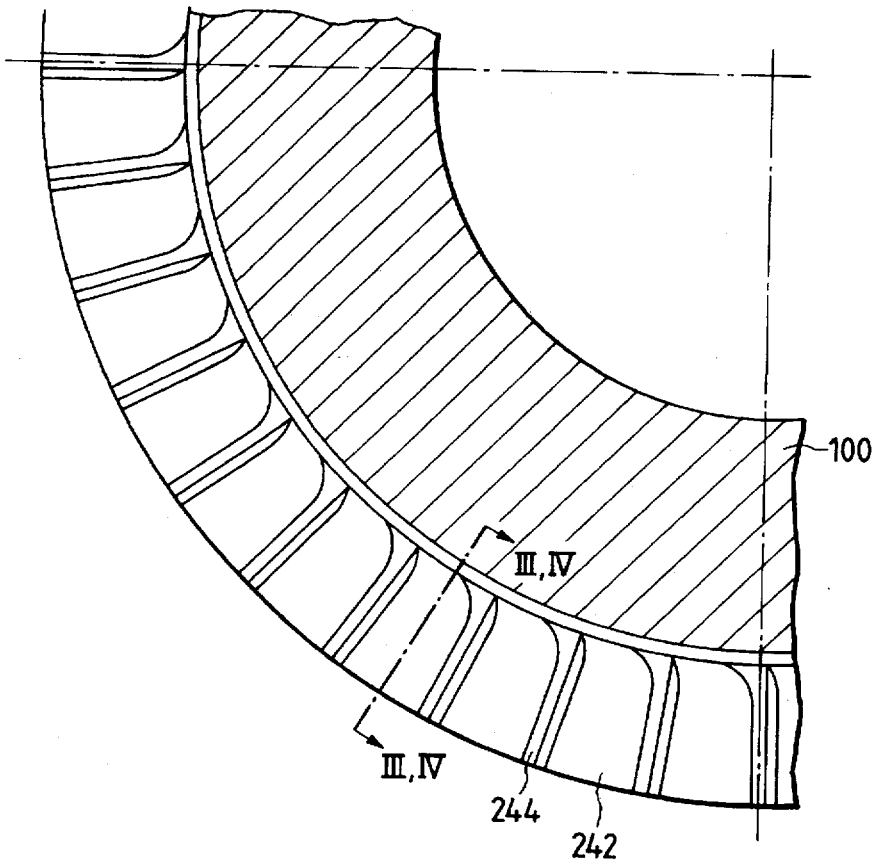
FIG. 6 is a top view of the circumferential impeller shown in FIGS. 3 and 4.

FIGS. 3 to 6 show a circumferential impeller used in the embodiment described thus far. This circumferential impeller is constructed by arranging a plurality of radially extending blades 244 (all having substantially the same thickness) around the periphery of a circular plate 242, with grooves 246 formed between the blades. Further, as shown in FIGS. 3 and 4 (taken along lines III—III and IV—IV in FIG. 6), the groove bottoms 248 between the blades of the circumferential impeller are radially shaped to have a set of interrupted linear lines or steps. As shown in FIG. 5*b* (viewed in the direction shown by the arrow V, VIII in FIG. 6), moreover, the groove bottoms 248 between the blades of the circumferential impeller may be circumferentially shaped to have a plurality of arcs. As shown in FIG. 6 (sectioned along line VI—VI in FIG. 56), the blades of the circumferential impeller may be arcuate at their radially inward ends 247 on the core plate 242. (In the embodiment of FIG. 4, the arcuate portions are, of course, likewise formed by steps.)

The manner in which the pump rotor 100 and the pump stator 120 cooperate is best seen in the enlarged cross-sectional view of FIG. 5*a*, which shows the constructional details of the peripheral flow pump stages within the circle VA in FIG. 1.

Because of the shapes as indicated, the circumferential impeller can be worked by a numerical controlled machine. As a result, the accuracy of the dimensions of the circumferential impeller is improved, reducing the variation in performance. Moreover, because the peripheral flow pump and the centrifugal pump can be integrated, assembly is more efficient. Furthermore, the machined rotor is preferable to the cast rotor because the imbalance due to the casting defects can be reduced, shortening the balancing time required. On the other hand, the pressure ratio can be improved by 10 to 30% if the blade end portions of the circumferential impeller, as located at the periphery of the base plate, are inclined by an angle θ (θ:5 to 40 degrees) in the direction of rotation (as indicated by an arrow), as shown in FIG. 5*b*.

It should be noted that, in the foregoing embodiment, the groove bottoms between the blades may be radially shaped to have a set of interrupted linear lines or steps, or may be circumferentially shaped to have a plurality of arcs; or the blades may be radially internally arcuate at their core plate sides. All of these shapes need not be satisfied; rather, but any of them will be sufficient if it can be machined.

Moreover, while the present embodiment is designed to be made by machining using an end mill the invention is also applicable to similar machining processes using tools other than an end mill.

Figure 7:
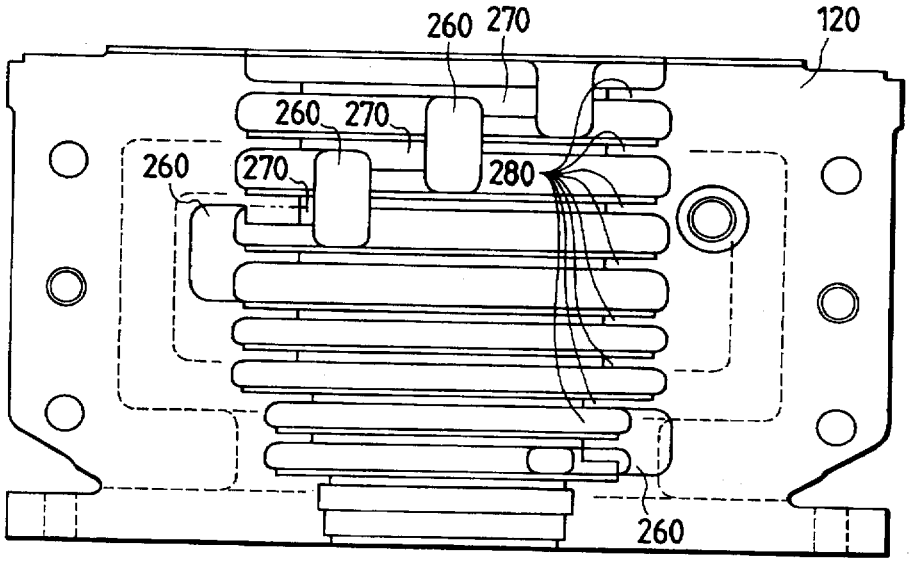
FIG. 7 shows a cross-sectional view of a pump stator according to the present invention.

FIG. 7 shows another view of stator 120 of the dry turbo vacuum pump shown in FIG. 1. In the present embodiment, the peripheral flow pump is composed of eight stages, of which the upper first to sixth stages have a common internal diameter, while the seventh and eighth stages share a smaller common internal diameter. Moreover, the portions of the interstage walls 280 (between the stages of the stator) which face the impeller are made flat. (See FIG. 5*a*.) Thus, the molds can simply be removed after casting, and the precision casting process required by the prior art can be replaced by a less costly casting process. As a result, the cost for material can be reduced to about one tenth that of the prior art.

Figure 8:
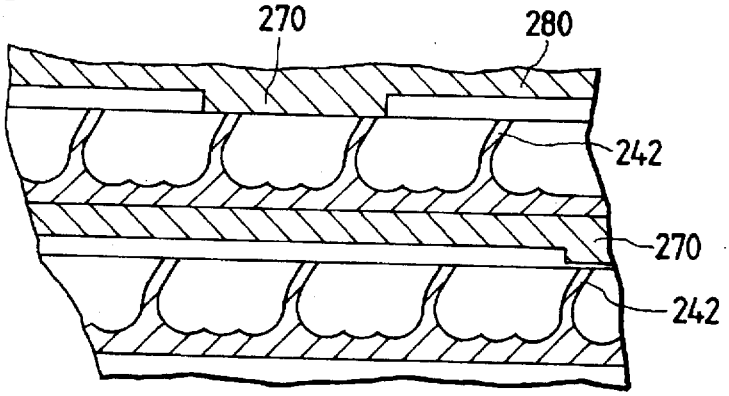
FIG. 8 is a view taken from the outer circumference of a sluice portion of the present invention.

As shown in FIG. 8, each interstage wall 280 of the stator 120 is formed with a sluice portion 270 which has a circumferential extent greater than the blade pitch of the impeller, so as to permit engagement with two or more blades. In this manner, the gas compressed at each stage is caused to flow into the subsequent stage, neither circulating in the pump nor leaking internally. Moreover, the sluice portions 270 are sequentially staggered in the circumferential direction, each being situated downstream of the previous one, as shown in FIG. 7, thereby equalizing the circumferential distribution of the thrust, and reducing the axial size of the stator 120.

Figure 9:
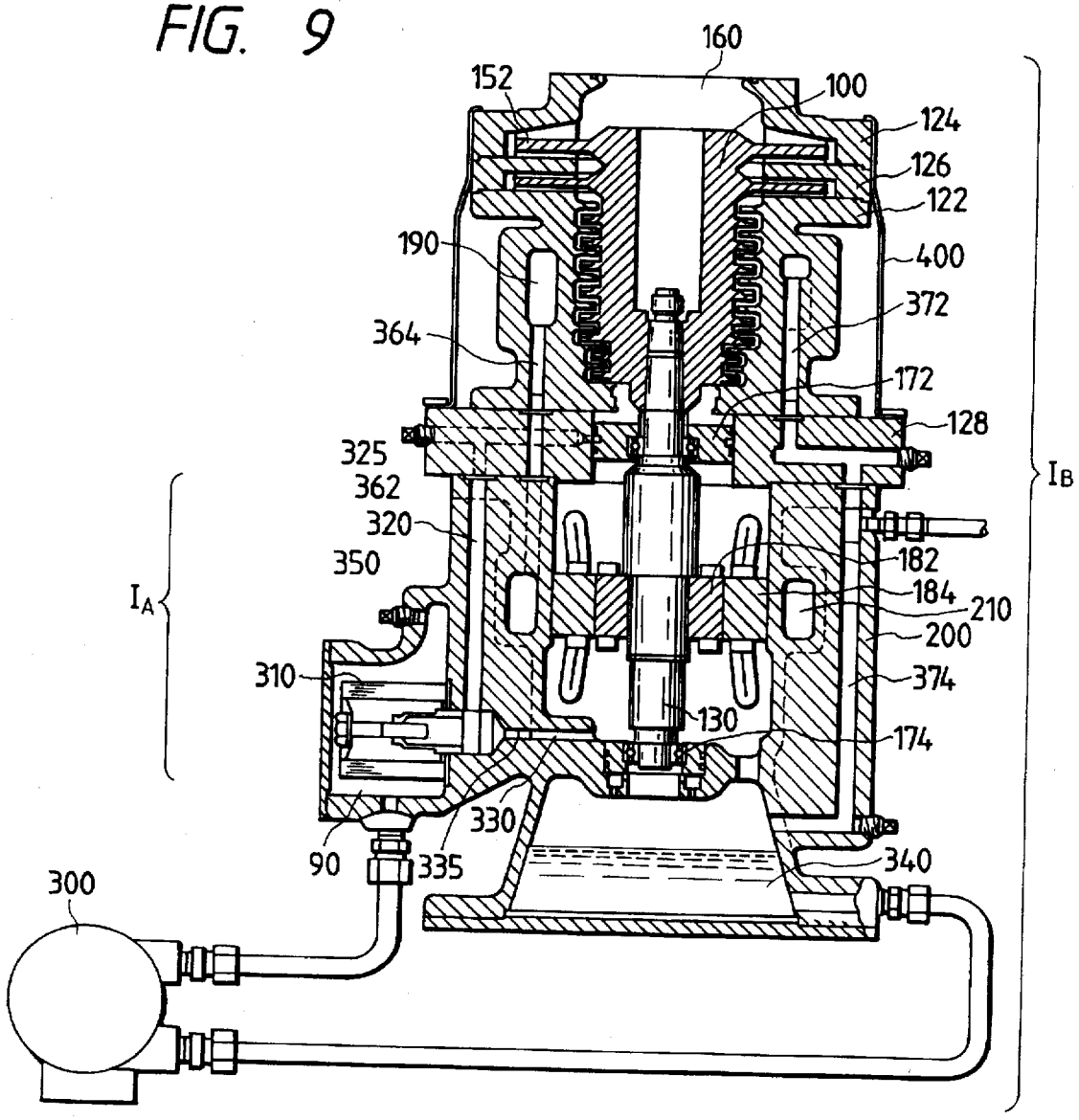
FIG. 9 is a longitudinal section showing a lubricating oil circuit according to the present invention.

FIG. 9 shows an embodiment of the lubricating oil circuit of the present invention, in which the lubricating oil has two functions: to lubricate/cool the bearings and to cool the pump body and the motor. The oil is fed to the motor casing 200 by an oil pump 300 and is filtered by an oil filter 310 mounted in a receptacle formed in the side of the motor casing 200. The oil is branched into first and second lines which perform respectively the above two functions. In a first line, which lubricates and cools the bearings, filtered oil is fed to the upper bearing 172 via a passage 320 formed in the motor casing 200, and to the lower bearing 174 via a passage 330 formed also in the casing 200. Along the passages 320 and 330, there are fitted orifices 325 and 335 by which the rates at which oil is fed to the individual bearings can be regulated. The oil having lubricated/cooled the individual bearings flows down into the space formed near the shaft in the motor casing and in the space formed below the bearing until it returns to an oil tank 340 in the motor casing 200.

In the second line, for cooling the motor and the pump body, the oil supplied by the oil pump 300 is fed to the motor cooling jacket 210 via a passage 350 formed in the motor casing, bypassing the oil filter 310, to cool the motor. Thereafter, the oil is fed to the cooling channel 190 of the stator 120 by passages 362 and 364. The oil thus having cooled the pump stages returns to the oil tank 340 in the motor casing by way of communication passage 372 and 374, and is cooled by an oil cooler (not shown) and is supplied again to the motor casing 200 by the oil pump 300. The circulation of oil through the lines described above is performed continuously while the pump operates.

In FIG. 9, as in FIG. 1*a*, Section $I_B$ shows the details of the oil supply system, and is viewed along a plane which is rotated 90° relative to Section $I_A$.

Figure 10:
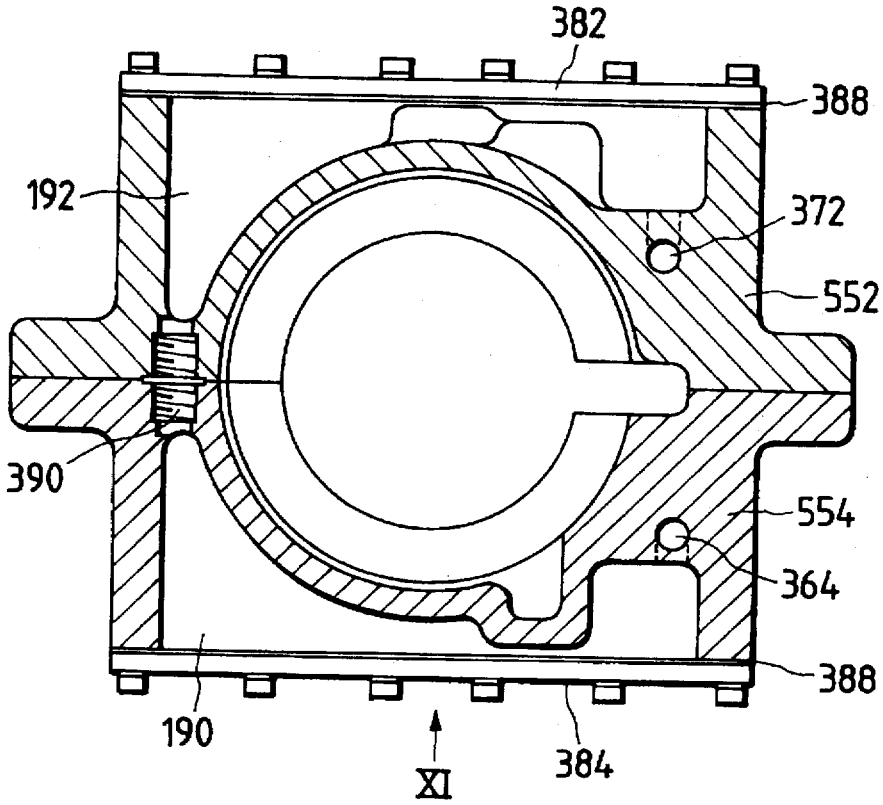
FIG. 10 is a transverse section showing the stator according to the present invention.
Figure 11:
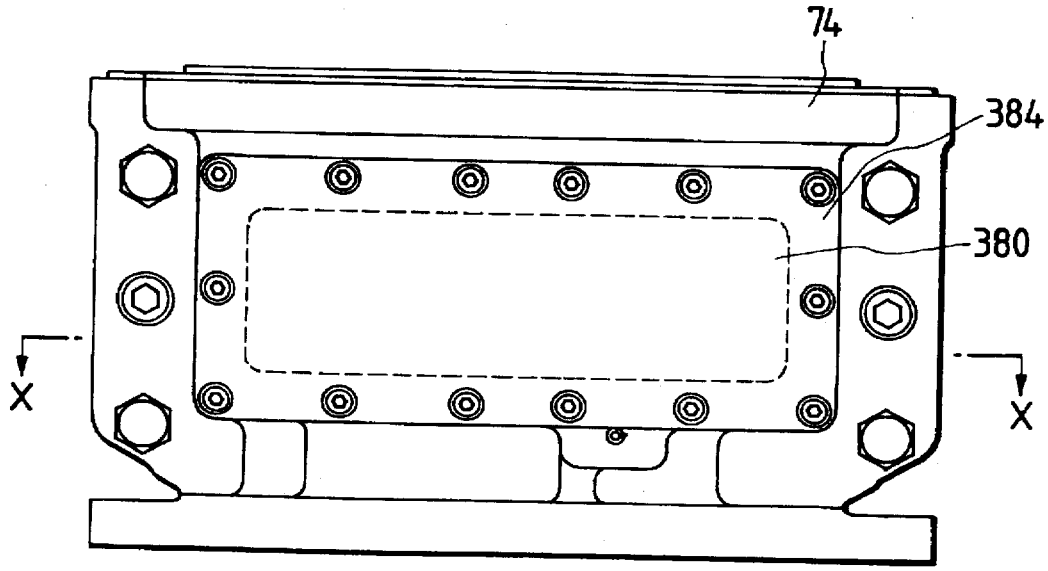
FIG. 11 is a side elevation showing the stator according to the present invention.

One embodiment of the cooling channel 190 formed in the stator 120 is shown in greater detail in FIGS. 10 and 11. (FIG. 10 is a cross-sectional view of the stator taken along line X—X in FIG. 11, while FIG. 11 is a side view from the direction XI in FIG. 10.) The stator 120 is formed with a surrounding cooling channel generally around its outer periphery. This space is constructed by covering its opening 380 by means of a packing 388 or the like with channel covers 382 and 384, which are held by means of screws. The stator 120 is split into two halves which are formed with holes 390 to permit the oil having been fed to one side of the channel from the communication passages 364 to flow into the other side of the channel. The communication passage 364 and 372 are formed in ribs 552 and 554 on the outer circumference of the stator 120. As a result, external piping can be eliminated, thereby improving the workability, and preventing piping problems during transportation and operation.

Figure 12:
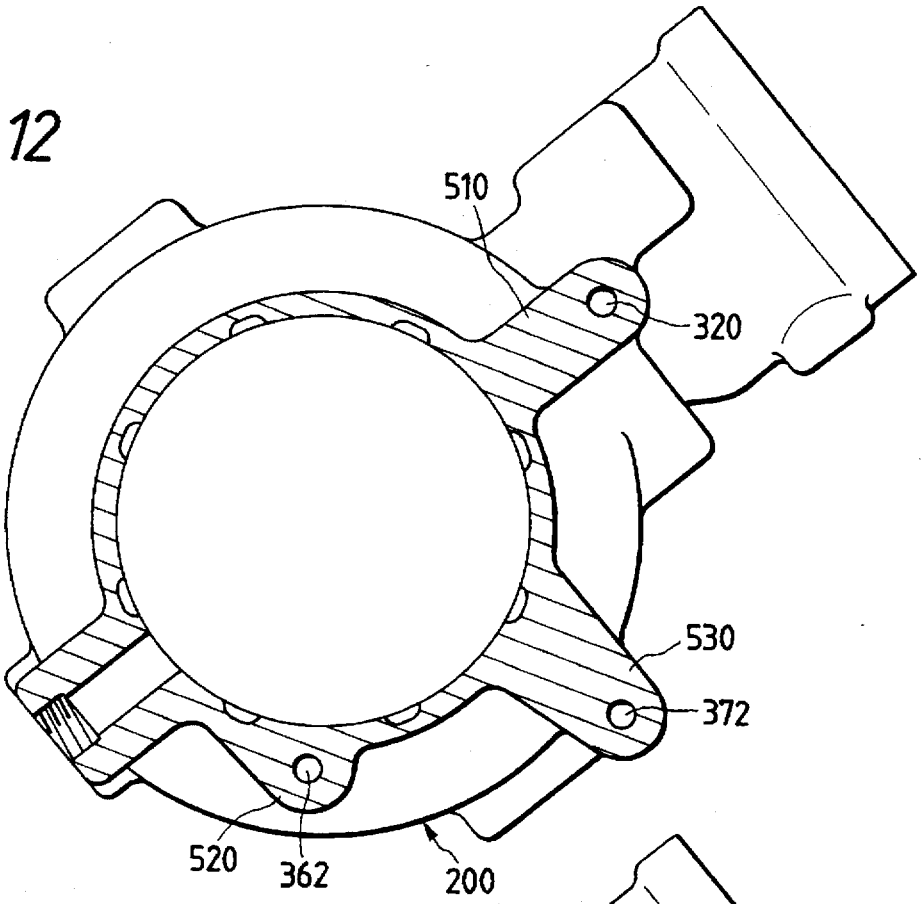
FIG. 12 is a transverse section showing a motor casing according to the present invention.
Figure 13:
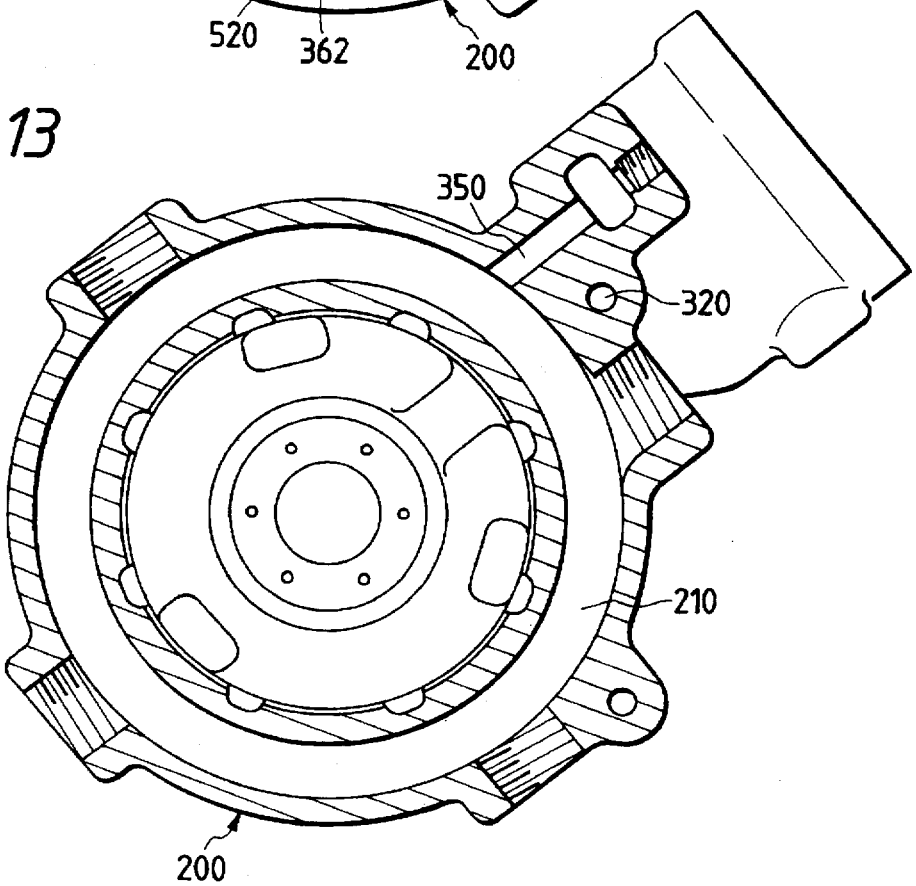
FIG. 13 is a transverse section showing the motor casing according to the present invention.

FIGS. 12 and 13 are views of an embodiment of the cooling channel 210 and the individual communication passages of the motor casing, taken along line XII—XII and XIII—XIII in FIG. 1. The outer circumference of the motor casing is formed with ribs 510, 520 and 530, in which are formed the communication passages 320, 362 and 372. This cooling channel of the motor casing can also eliminate the need for external piping as in the case of the stator, thereby simplifying assembly.

Figure 14:
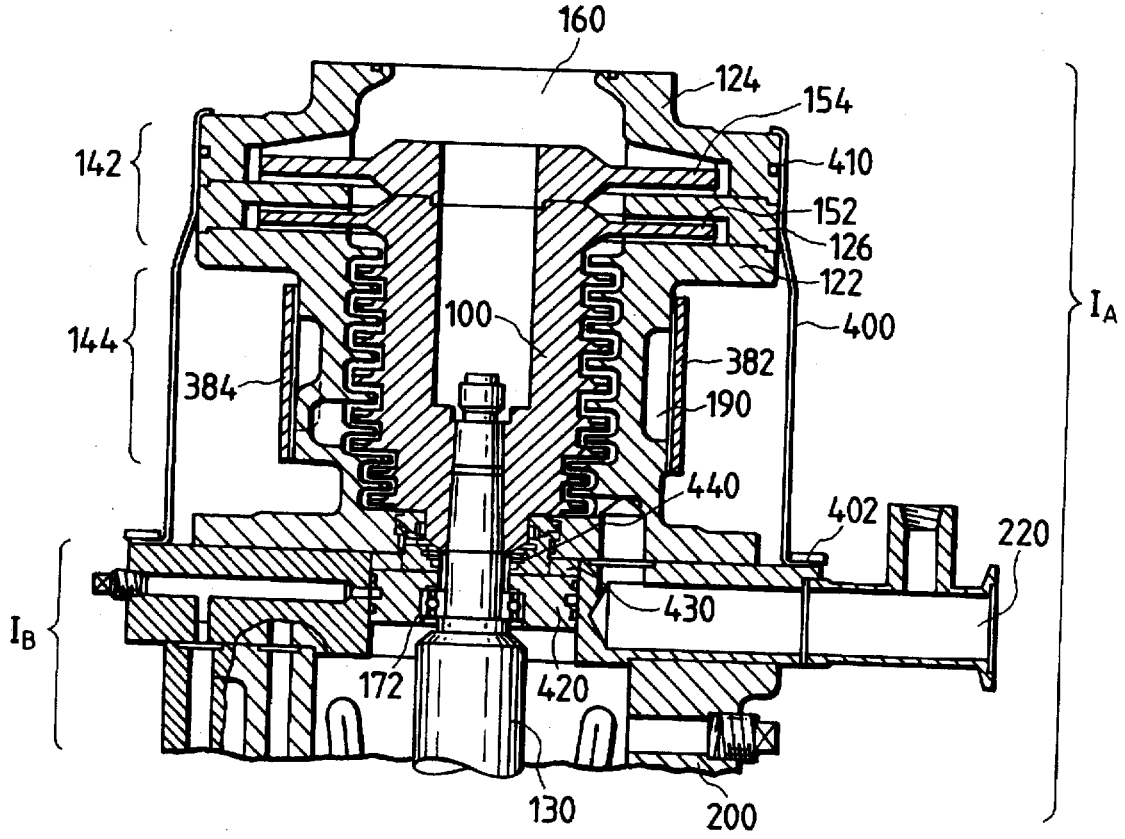
FIG. 14 is a longitudinal section showing another embodiment of the present invention.

FIG. 14 shows another embodiment of the present invention, and is a sectioned in the same manner as FIGS. 1*a* and 9. An outer casing 400 is formed into such a cylindrical shape as to cover the outer circumference of the stator 120 and the suction casing 150. The outer casing 400 has its upper portion supported by an O-ring 410 arranged on the outer circumference of the stator, and its lower end formed into a flange shape which is fixed by means of bolts. Because of this structure, the outer casing 400 can be freely removed to facilitate easy assembly. Moreover, a bearing holder 420 and a halved holder spacer 430 are made separate. As a result, it is unnecessary to remove the rotor 100 from the shaft 130 as is required in the prior art, to adjust the length of a collar 440 in the gap adjusting works of the rotor 100 and the stator 120. Rather, such gap adjustment may be made merely by adjusting the thickness of the holder spacer 430. Neither disassembly nor reassembly of the rotor 100 and the shaft 130 are required, shortening the assembly time for one pump by about six hours.

Figure 15:
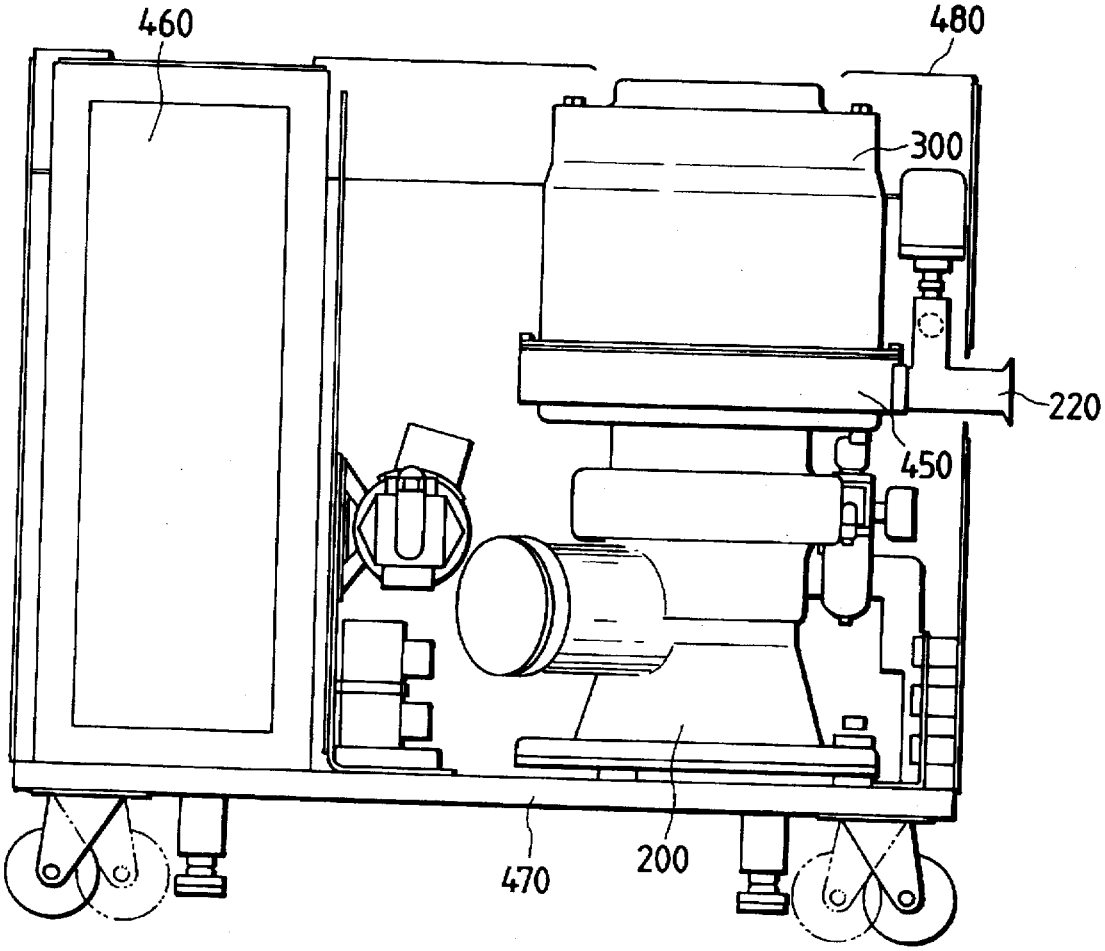
FIG. 15 is a longitudinal section showing a package type evacuator carrying a dry turbo vacuum pump according to the present invention.

FIG. 15 shows one embodiment of an apparatus which carries the dry vacuum pump according to the present invention. A pump body 450, a pump control unit 460 and another accessory are mounted on a carriage 470 and are packaged by covering them with a cover 480. This package requires no wiring between the pump body 450 and the pump control unit 460. Moreover, the pump can be started instantly merely by connecting the apparatus with facilities which are ordinarily found in factories, such as a power supply, a water supply/drainage and a shaft sealing gas.

Figure 16:
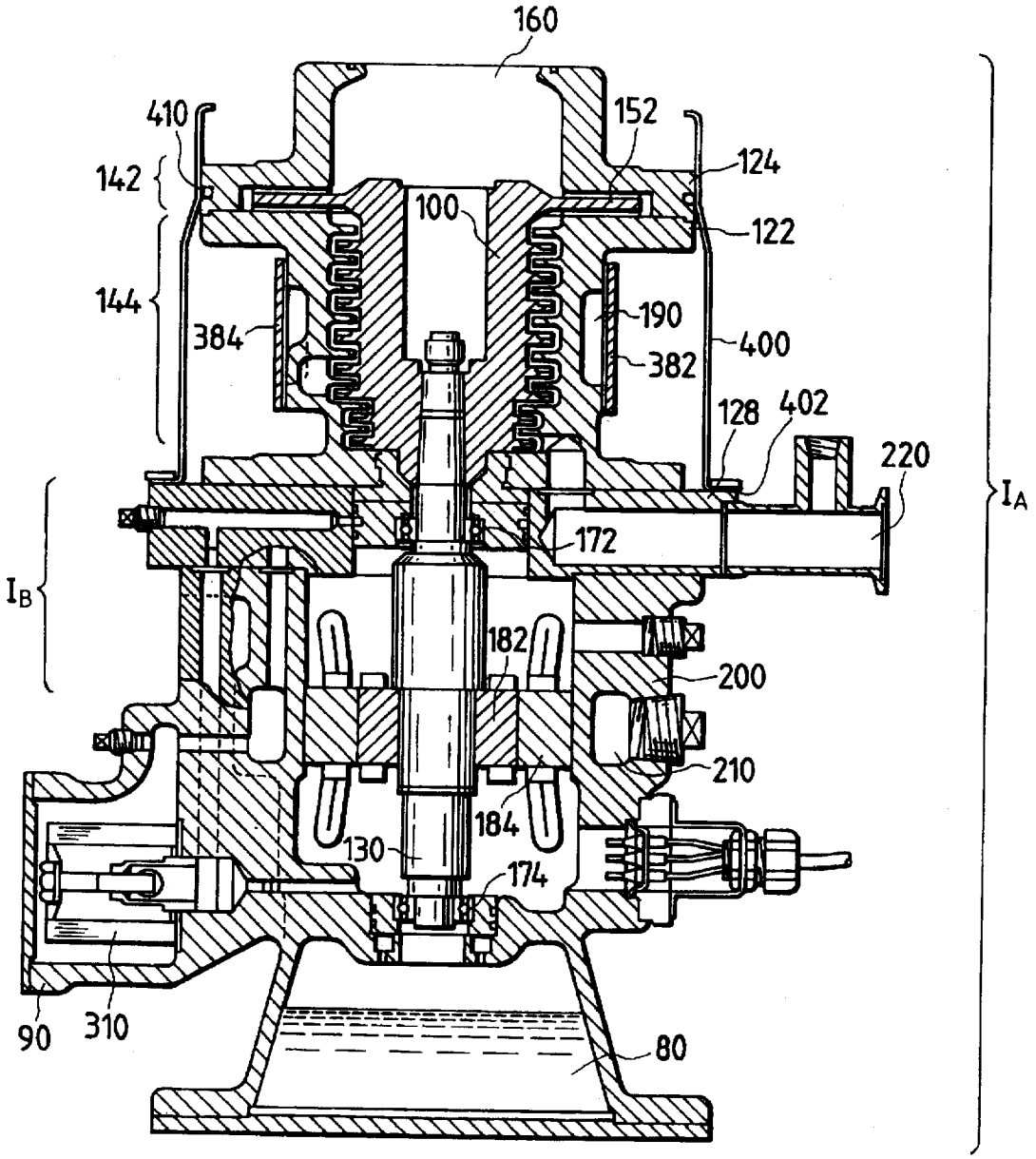
FIG. 16 is a longitudinal section showing a modification of the present invention.
Figure 17:
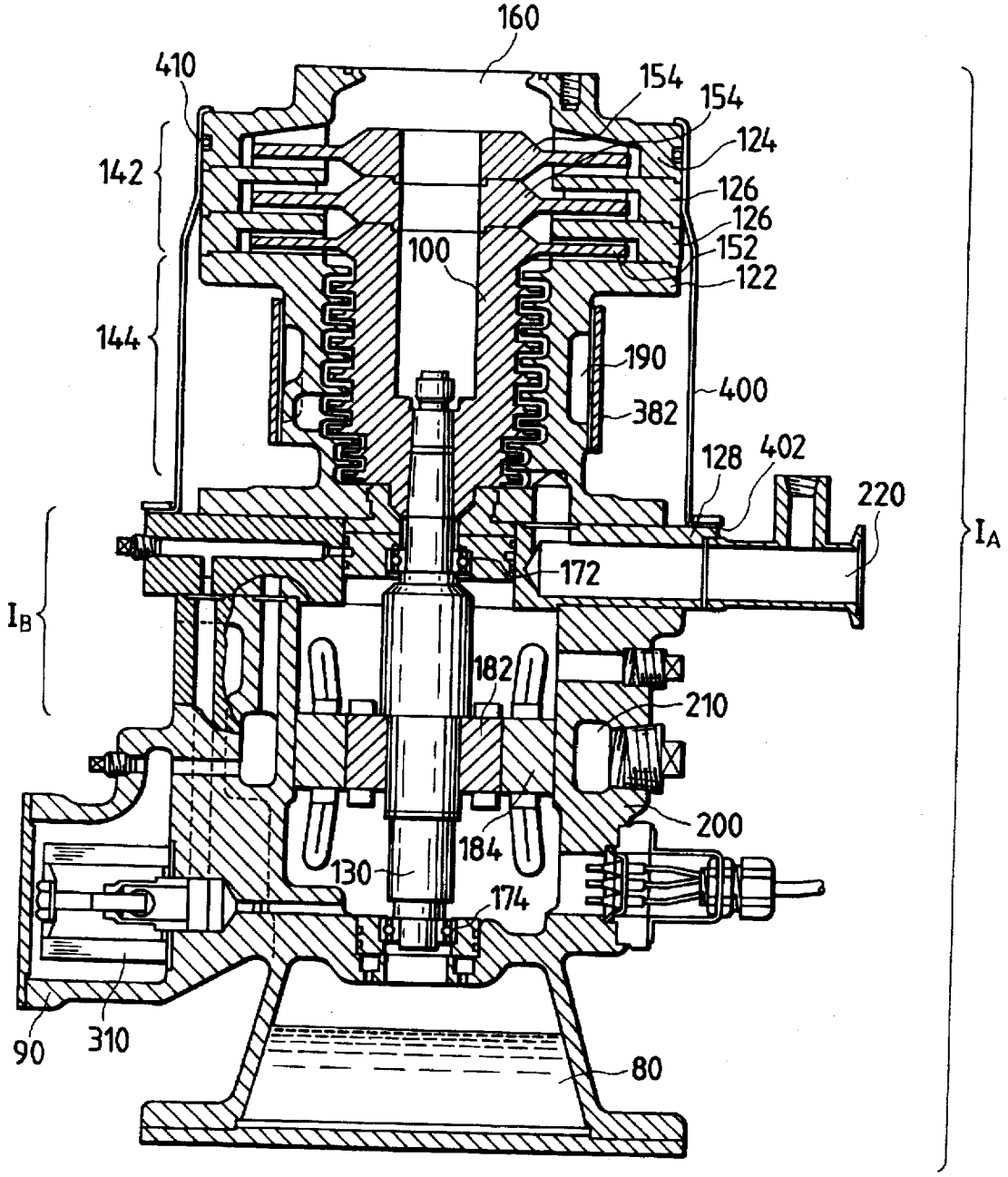
FIG. 17 is a longitudinal section showing another modification of the present invention.

FIGS. 16 and 17, which are sectioned in the same manner as FIGS. 1*a*, 9 and 14, show a modification of the dry vacuum pump of the present invention, as conceived to change the flow rate. When the flow rate is to be decreased, detachable centrifugal pump stages are removed from the upper portion of the integrated structure which comprises the centrifugal pump stages and the peripheral flow pump stages. When the displacement is to be increased, a detachable centrifugal pump stage is added to the upper portion of the integrated centrifugal pump stages, and the suction casing 150 is mounted on or above the stator of the centrifugal pump stage. As a result, the flow rate can be changed from 1,000 liters per minute to 9,000 liters per minute merely by changing only the number of stages of the centrifugal pump. The parts can be made common to reduce the costs for the material and the assembly.

According to the present invention, at least one of the peripheral flow pump stages and the centrifugal pump stages is integrated, so that the rotor of the vacuum pump can be made by a machining process, while improving and eliminating the variation of performance.

Thanks to the drastic reduction of the external piping, moreover, the assembly time can be shortened to one half that of the prior art, thereby improving the reliability of the piping lines during transportation and operation.

Furthermore, the stator manufacturing process is executed by the ordinary casting process in place of the requisite high precision process of the prior art, so that the cost for manufacturing the stator can be lowered to about one tenth that of the prior art.

Although the invention has been described and illustrated in detail, it is to be clearly understood that the same is by way of illustration and example, and is not to be taken by way of limitation. The spirit and scope of the present invention are to be limited only by the terms of the appended claims:

What is claimed:

1. A dry turbo vacuum pump comprising:

a housing having an inlet and an exhaust duct;

a shaft rotatably supported in said housing;

a multistage peripheral flow impeller secured on said shaft and located in said housing; and at least a first centrifugal impeller disposed at an inlet side of said peripheral flow impeller, whereby gas sucked from said inlet is discharged through said exhaust duct;

wherein said peripheral flow impeller is integrated with said at least a first centrifugal impeller to form a unitary pump rotor.

2. A vacuum pump according to claim 1 wherein said at least a first centrifugal impeller is secured on said shaft and fixedly coupled to said peripheral flow impeller.

3. A vacuum pump according to claim 1 wherein:

each stage of said peripheral flow impeller has a hub and a plurality of vanes which are spaced from each other along a periphery of said hub forming grooved recesses in said hub; and a peripheral cross-section of a bottom surface of the grooved recesses comprises a plurality of circular arcs, whereby said peripheral flow impeller can be manufactured by machining.

4. A vacuum pump according to claim 1 further comprising:

at least a second centrifugal impeller detachably coupled to said first centrifugal impeller at an inlet side of said centrifugal impeller.

5. A dry turbo vacuum pump comprising:

a housing having an inlet and a exhaust duct;

a shaft rotatably supported in said housing;

a multistage peripheral flow impeller secured on said shaft and located in said housing; and at least a first centrifugal impeller disposed at an inlet side of said peripheral flow impeller whereby gas sucked from said inlet is discharged through said exhaust duct;

said housing further comprising, a multistage stator disposed between said inlet and said exhaust duct, which cooperates with said peripheral flow impeller to form a multistage peripheral flow pump having walls arranged between the stages;

wherein inner diameters of at least two neighboring stages of said housing are substantially identical; and wherein a surface of said walls is substantially flat.

6. A vacuum pump according to claim 5 wherein each of said walls has a gas flow blocking member which engages with edges of said vanes, and has a circumferential length at least equal to a circumferential distance between said vanes of said peripheral flow impeller.

7. A vacuum pump according to claim 6 wherein said gas blocking members are arranged in different peripheral positions on said wall plates.

8. A dry turbo vacuum pump comprising:

a housing having an inlet and an exhaust duct.

* * * * *

UNITED STATES PATENT AND TRADEMARK OFFICE

CERTIFICATE OF CORRECTION

PATENT NO. : 5,664,935

DATED : September 9, 1997

INVENTOR(S) : Akira Nishiuchi et al.

It is certified that error appears in the above-indentified patent and that said Letters Patent is hereby corrected as shown below:

In the claims, replace Claim 8 with the following:

--8. A dry turbo vacuum pump comprising:

a housing having an inlet and an exhaust duct;

a shaft supported rotatably in said housing;

a multistage peripheral flow impeller secured on said shaft;

and a multistage centrifugal impeller secured on said shaft, said multistage centrifugal impeller being integrated with said multistage peripheral flow impeller to form a unitary pump rotor;

UNITED STATES PATENT AND TRADEMARK OFFICE

CERTIFICATE OF CORRECTION

PATENT NO. : 5,664,935

DATED : September 9, 1997

INVENTOR(S) : Akira Nishiuchi et al.

It is certified that error appears in the above-indentified patent and that said Letters Patent is hereby corrected as shown below:

said housing comprising a stator unit integrated therein, which stator unit cooperates with said pump rotor to form a multistage centrifugal pump integrated with a multistage peripheral flow pump, an outlet of said centrifugal pump being arranged at an inlet of said peripheral flow pump, whereby gas sucked from said inlet is discharged from said exhaust duct.--

Signed and Sealed this

Twenty-fifth Day of August, 1998

Bruce Lehman

*Attest:*

BRUCE LEHMAN

*Attesting Officer*

*Commissioner of Patents and Trademarks*